US007086181B2

(12) United States Patent
Farys

(10) Patent No.: US 7,086,181 B2
(45) Date of Patent: Aug. 8, 2006

(54) ARTICLE OF FOOTWEAR

(75) Inventor: Yves Farys, Saint-Jorioz (FR)

(73) Assignee: Salomon S.A., Metz-Tessy (FR)

( * ) Notice: Subject to any disclaimer, the term of this patent is extended or adjusted under 35 U.S.C. 154(b) by 82 days.

(21) Appl. No.: 10/864,450

(22) Filed: Jun. 10, 2004

(65) Prior Publication Data

US 2004/0250452 A1 Dec. 16, 2004

(30) Foreign Application Priority Data

Jun. 12, 2003 (FR) ..... 03 07032

(51) Int. Cl.
*A43B 5/04* (2006.01)

(52) U.S. Cl. ..... 36/50.5; 36/117.6

(58) Field of Classification Search ..... 36/50.1, 36/50.5, 117.6
See application file for complete search history.

(56) References Cited

U.S. PATENT DOCUMENTS 4,253,251 A * 3/1981 Salomon ..... 36/117.9
4,800,659 A * 1/1989 Marega ..... 36/117.9
4,969,278 A * 11/1990 Ottieri ..... 36/117.8
5,566,475 A 10/1996 Donnadieu ..... 36/55
5,906,057 A 5/1999 Borsoi ..... 36/50.1
5,950,335 A * 9/1999 Okajima ..... 36/115
6,467,193 B1 * 10/2002 Okajima ..... 36/10
2002/0062579 A1 5/2002 Caeran ..... 36/115
2002/0139008 A1 10/2002 Delgorgue et al ..... 36/50.1
2002/0174568 A1 * 11/2002 Neiley ..... 36/50.1

FOREIGN PATENT DOCUMENTS

| | | |
|---|---|---|
| EP | 0962158 | 12/1999 |
| EP | 1040768 | 10/2000 |
| EP | 1219190 | 7/2002 |
| EP | 1316268 | 6/2003 |
| FR | 2752683 | 3/1998 |
| FR | 2802781 | 6/2001 |

* cited by examiner

*Primary Examiner*—Ted Kavanaugh
(74) *Attorney, Agent, or Firm*—Greenblum & Bernstein, P.L.C.

(57) ABSTRACT

An article of footwear of the type that includes upper, an outer sole, and the following elements, listed from the inside toward the outside of the article of footwear: a comfort liner; a frame for holding the foot and for transmitting forces, made of a substantially inextensible material to transmit the forces for tightening the foot and to hold the foot; and an outer envelope for protecting against exterior elements.

25 Claims, 6 Drawing Sheets

ARTICLE OF FOOTWEAR

CROSS-REFERENCE TO RELATED APPLICATION

This application is based upon French Patent Application No. 03.07032, filed Jun. 12, 2003, the disclosure of which is hereby incorporated by reference thereto in its entirety and the priority of which is hereby claimed under 35 U.S.C. §119.

BACKGROUND OF THE INVENTION

1. Field of the Invention

The invention relates to an article of footwear, such as a mountain boot, and such as a mountain boot adapted for mountain racing.

2. Description of Background and Relevant Information

For an article of footwear, or for a boot, of the aforementioned type, the upper must fulfill several functions, such as the following:

- stability of the foot and of the ankle and protection against sprains, particularly on sloping or uneven terrain;
- "impermeability" or protection of the boot from the exterior, particularly rain and snow, but also a mechanical protection of the foot against debris, sharp stones, or other exterior attacks;
- foot comfort and, depending on the type of boot, thermal protection.

Traditionally, boots of this type have an external upper that is made from very thick and strong leather, lined on the inside with comfort layers such as foam materials, and having an inner coating, such as leather.

Such boots are very heavy and have a minimum weight of about 2.8 kg per pair, or about 6.17 lbs per pair.

More recently, boots have been proposed whose outer upper is in fact a plastic shell, consequently particularly rigid and impermeable, and whose comfort is ensured on the inside by a removable liner.

Such boots are even heavier and have a minimum weight of about 3 kg per pair, or about 6.61 lbs per pair. Furthermore, their construction is very expensive as they require at least one pair of molds per boot size.

Even more recently, boots have been marked having a so-called mixed upper, i.e., one in which the outer upper is constituted of a strong fabric, such as the one known under the commercial name of CORDURA®, coated with a synthetic material.

Such boots tend to be lighter. However, their weight is still on the order of 2.6 kg per pair, or about 5.73 lbs per pair, and, furthermore, they are not suited for use in high mountains due to their lack of rigidity.

SUMMARY OF THE INVENTION

An object of the present invention is to overcome the drawbacks of known boots and to propose a new boot construction that provides for a noticeably lightened weight for a pair of boots, while offering a good stability and protection of the foot and of the ankle and guaranteeing isothermic properties, if needed.

Another object of the present invention is to propose a boot modular in design, facilitating the adaptation of the construction of a boot to a particular use.

This object is achieved in an article of footwear that includes an upper and an outer sole, according to the invention, wherein the upper has, from the inside to the outside of the article of footwear the following:

- a comfort liner;
- a frame for holding the foot and for transmitting forces, made of a substantially inextensible material and adapted to transmit the forces for tightening the foot and to hold the foot;
- an outer envelope for protecting against exterior elements.

Such a boot construction permits the separation of the functions of comfort, holding the foot, and transmitting the forces, and protection against exterior elements over three different layers, in contrast with prior art boots in which the outer upper generally has a double function of protecting against exterior elements and of holding the foot/transmitting the forces.

As a result, the materials of each of the three functional "layers" of the boot can be optimized, in terms of function and weight, and one can therefore obtain a boot construction that is much lighter.

In this manner, the frame can be made from a very light-weight material while being selected so as to be able to transmit the forces to which this type of boot is subjected, and to ensure the desired holding/support of the foot/ankle.

By contrast, in the prior art, as in the case of leather boots, the material of the outer upper should be selected from a very thick, and therefore inevitably heavier leather, in order to ensure the functions for transmitting the forces and holding the foot, as well as the functions for protection against exterior elements.

Moreover, the separation of the functions in the boot according to the invention allow having a much more modular boot construction, in which it suffices to modify the characteristics of a functional layer to provide a boot having a completely different behavior.

BRIEF DESCRIPTION OF DRAWINGS

The invention will be better understood, and other advantages and functional characteristics thereof will become apparent from the following description, with reference to the attached schematic drawings showing, by way of non-limiting examples, several embodiments, in which.

DETAILED DESCRIPTION OF THE INVENTION

FIG. 1–4 show a first embodiment of the invention applied to a so-called mountain boot 1.

Figure 1:
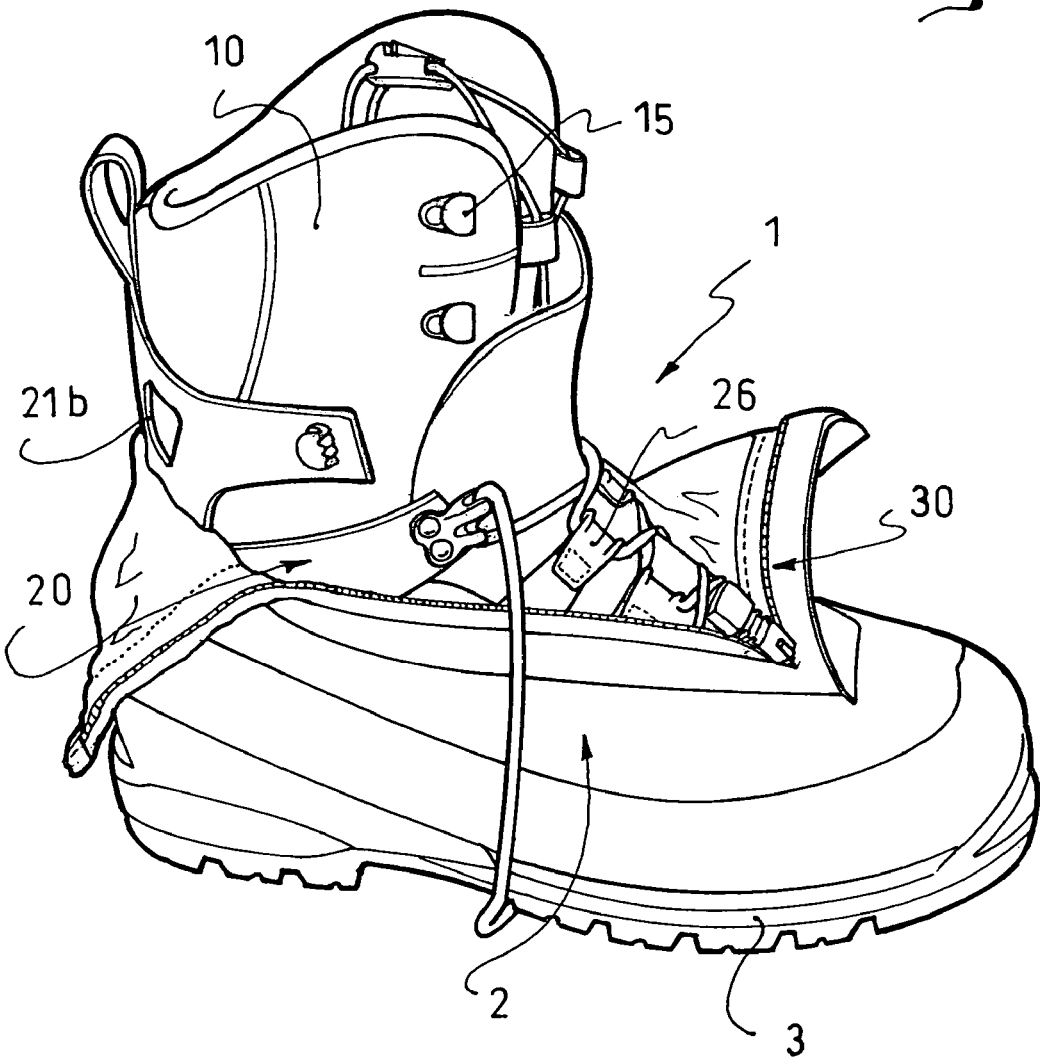
FIG. 1 is a side view of a boot according to the invention.
Figure 2:
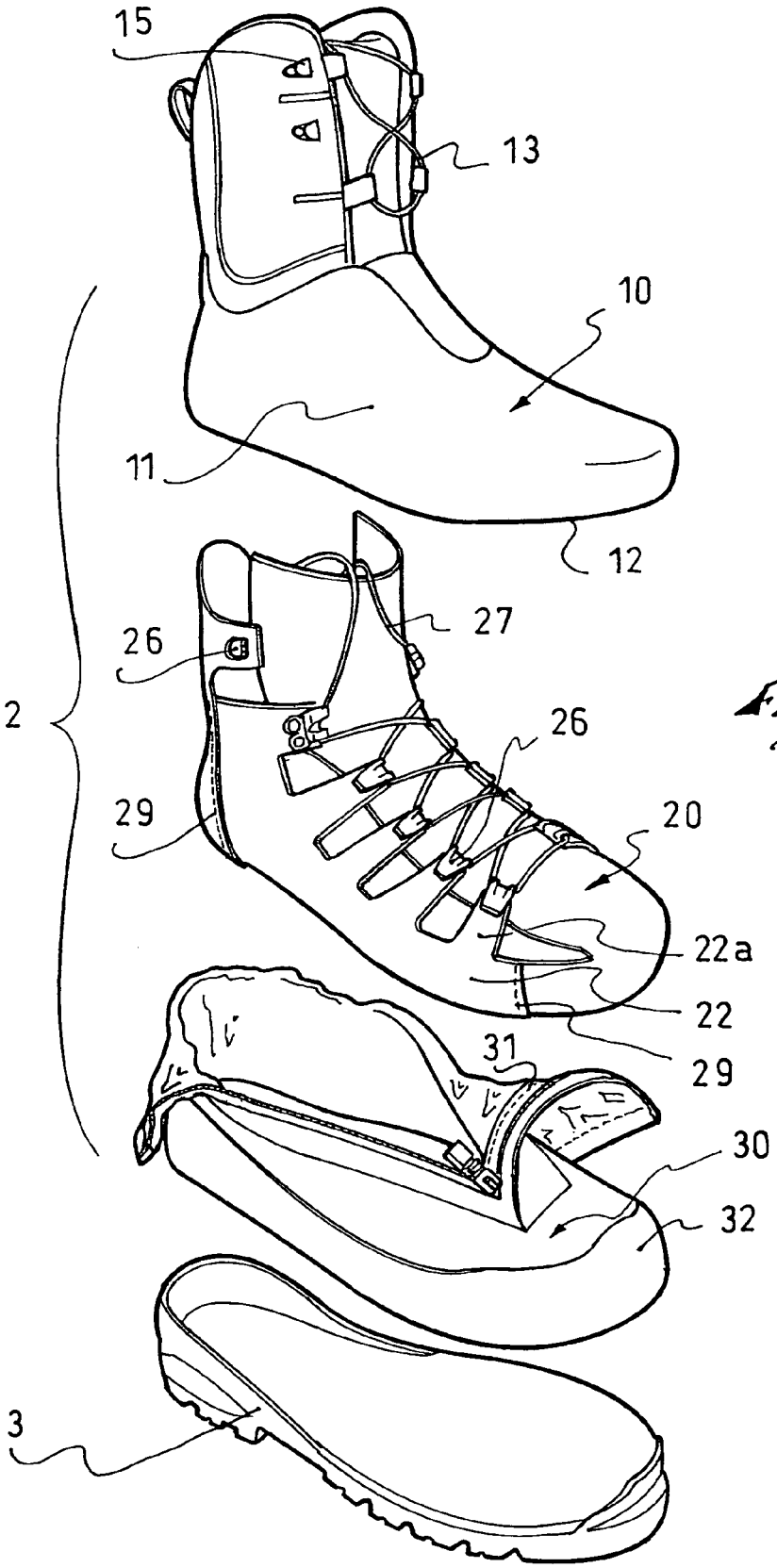
FIG. 2 is an exploded perspective view of the boot of FIG. 1.

As shown in particular in FIGS. 1 and 2, this boot 1 includes an upper 2, in this case a high upper because it relates to a mountain boot, and an outer sole 3. The upper 2 includes three different functional layers from the inside outward, namely:

a comfort liner 10;

a frame 20 adapted to ensure the holding of the foot and, in the present case of a mountain boot, the ankle as well, and the transmission of forces, particularly the tightening forces;

an outer envelope 30 adapted to protect the whole boot from exterior elements.

In the first example, the comfort liner 10 is shown separate from the frame 20 and, consequently, the liner is removable. This type of removability is advantageous, for example, in order to dry the liner, or to allow the wearer to walk indoors while only wearing the liner, particularly in the case of mountain boots.

Traditionally, a liner such as liner 10 includes an upper 11, in this case a high upper, i.e., covering the ankle, a sole 12, and a lacing system 13. In the present case, the lacing system 13 is substantially provided in the high portion, covering the ankle, of the upper 11 of the liner, but, as the case may be, it could also extend over the foot portion of this liner.

The lacing system 13 is adapted to ensure the tightening of the liner 10 about the foot/leg, particularly when the liner is removed from the frame 20. This lacing system 13 can be replaced by a VELCRO® type closure system. The liner 10 also laterally has hooks 15 adapted to cooperate with the system for lacing the frame 20, as further described below.

As is known, the liner 10 can include foam materials arranged between an inner envelope and an outer envelope.

In fact, the outer envelope 30 can be considered a type of gaiter, made of a flexible material, externally covering the entire frame 20 and liner and, consequently, extending from the top of the upper 2 to the bottom.

In the example shown, the outer envelope 30 is provided with a closure 31 of the slide fastener type. However, alternative type(s) of closures could be provided instead. FIG. 1 shows that the flexibility of the outer envelope 30 is such that, when opened with the slide fastener 31, it can be folded down to expose the upper extents of the frame 20 and the liner 10.

The outer envelope 30 is furthermore covered at its lower end, i.e., that located just above the sole 3, by a band 32, i.e., a band of rubber (or similar material), peripherally glued to the envelope so as to provide additional protection against abrasion.

The envelope 30 is made of a material selected depending on the type of protection to be provided.

In the case of a mountain boot, the envelope 30 can first of all be made from an abrasion-resistant material, such as that known under the commercial name CORDURA®.

If impermeability were to be desired, the envelope 30 can also be lined with a layer of material that is impermeable and preferably permeable to water vapor, such as known under the commercial name GORETEX®.

The frame 20 includes a heel stiffener 21, two tightening flanges 22, arranged on the medial and lateral sides of the boot, an end piece 23, a tongue 24, and a sole 25. The heel stiffener 21 encloses and surrounds not only the heel, but also the ankle. Depending on the type of boot, for example, a boot having a low upper or one sought to be more flexible, this stiffener 21 can surround only the heel portion itself of the user's foot.

The heel stiffener 21 is furthermore provided at its upper portion with two lacing extensions or tabs 21*a* bearing keepers 26 adapted to receive/guide a lace 27 for tightening the frame about the foot. The heel stiffener 21 has two vertical slots 21*c* adapted to soften the heel stiffener, such as making the heel stiffener more flexible, particularly more flexible in a certain area.

Each tightening flange 22 extends from the heel stiffener 21 and the sole 25 of the frame to the area of the user's instep girth.

In the case shown, each flange 22 includes a plurality of wings 22*a* extending in one direction, either substantially vertically or at an angle to the vertical, as considered with the boot supporting on a horizontal surface. Each wing 22*a* is provided at its free end with a keeper 26 adapted to receive the lace 27. Each keeper 26 can be of the type disclosed in the document FR 2 752 683 or U.S. Pat. No. 5,906,057, for minimum bulkiness and an efficient sliding. The disclosure of U.S. Pat. No. 5,906,057 is hereby incorporated by reference thereto in its entirety, particularly for this purpose. The wings 22*a* define, with the tabs 21*a* for lacing the stiffener and the hooks 15 for lacing the liner, the zone for lacing and tightening the foot and the ankle. The hooks/guides 15 of the liner allow recovering the forces for tightening the lower leg in the area of the liner. The entire tightening system could also be attached/transferred to the frame.

The flanges 22 can be made from a material that is more flexible than the heel stiffener 21, for more flexibility and a better adaptation to the volume of the foot.

The flanges 22 are assembled, for example, by stitches 29 to the heel stiffener 21 in an overlapping zone 28. Each overlapping zone 28 is defined by narrow portions 21*b*, 22*b* of the stiffener and tightening flanges 22, respectively. These respective narrow portions 21*b*, 22*b* are provided to have a sufficient length to allow two or more different boot sizes be made using the same elements 21, 22, respectively, by providing for overlapping to a greater or lesser extent, whether such sizes are those according to European, Mondopoint, American or another conventional shoe sizing system.

The end piece 23 is a toe niece adapted to ensure the shaping of the volume in order to receive the toes and possibly, i.e., depending on the type of boot, to provide a certain protection against shocks on the toes. The end piece 23 can form one piece with the tongue 24 that extends under the entire lacing zone, so as to allow for a good distribution of the tightening pressure. In the area of its junction with the tongue 24, the toe piece 23 has two lateral slits 23*a* to increase the flexibility of this zone and to allow a better tightening of the forefoot. Because the tongue 24 passes underneath the tightening wings 22*a*, the number of keepers 26 can be reduced as the tongue distributes the forces/pressures. As a result, one obtains a better sliding of the lace through the keepers 26, and the tightening is easier and more efficient.

As mentioned above, the end piece 23 has relatively narrow portions 23*b* provided to cooperate with the relatively narrow portions 22*b* of the flanges for their mutual connection by stitching 29 in an overlapping zone 28, and these narrow portions 23*b* are provided with dimensions that are sufficiently substantial in order to be compatible with two successive boot sizes.

Figure 3:
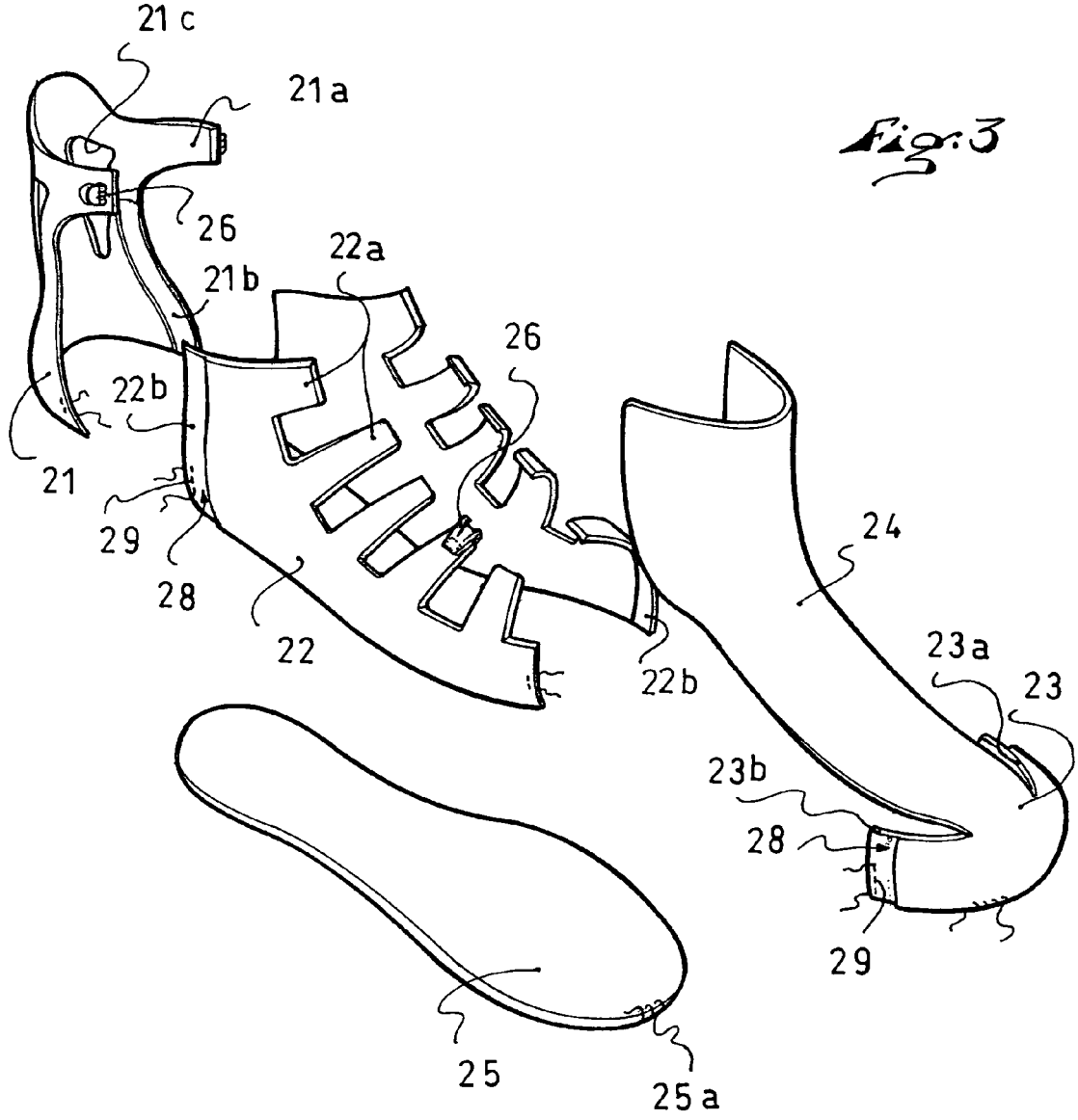
FIG. 3 is an exploded perspective view of the frame of the boot of FIG. 1.

As shown particularly in FIG. 3, the various elements 21, 22, 23, 24 of the frame are made independently and then assembled together, particularly by stitches 29. Other assembly methods, such as gluing, ultrasonic sealing, etc., can also be provided.

Making these elements independent allows the cost of the molds necessary for making them to be reduced, because their forms are less complicated, as well as the number of these molds, as a same assembly of these elements can enable two successive boot sizes be made.

Furthermore, these elements can be made from different materials, particularly with different rigidities or hardnesses.

By way of non-limiting-example, the elements 21, 22, 23, 24 can be made from polyurethane, PEBAX, and the hardness can be on the order of approximately 65–70 Shore A for the flanges 22, and approximately 85 Shore A for the heel stiffener 21 and the end piece 23/tongue 24.

Once they are assembled together, the different elements 21, 22, 23, 24 of the frame are assembled to the sole 25, for example, by a so-called strobel stitch 25*a*. The sole 25 is made, for example, of PE or EVA foam, or of a felt.

Figure 4:
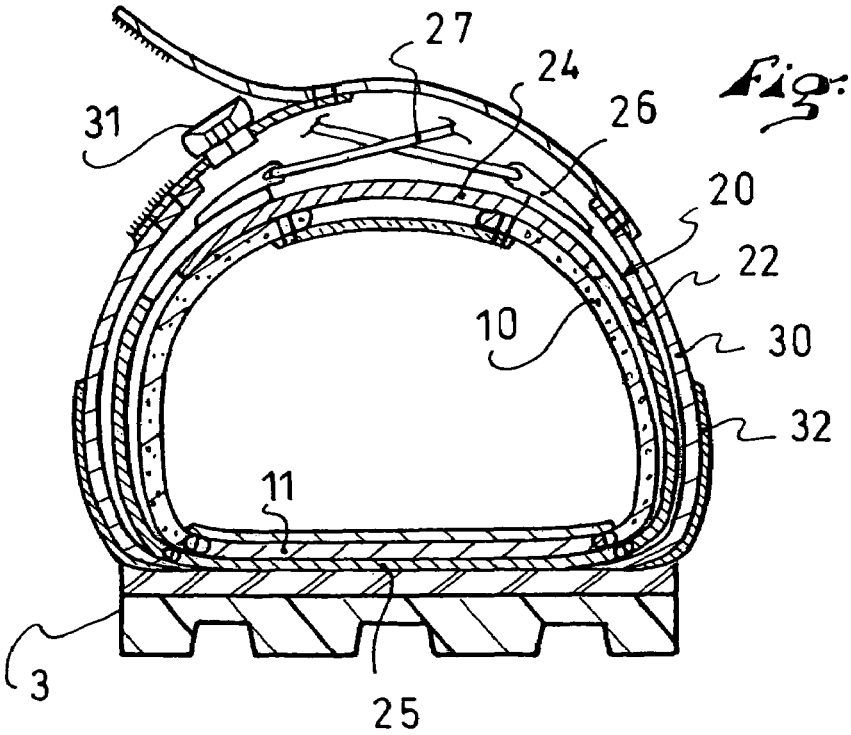
FIG. 4 is a transverse cross-sectional view of the boots of FIGS. 1–3.

As shown in FIG. 4, the assembly is then glued to the outer sole 3, after inserting the outer envelope 30 and its band 32. Therefore, as shown in FIG. 4, above a lowermost connection relative to the outer envelope, the frame 20 is separate from the outer envelope 30 above a lowermost connection relative to the outer envelope, i.e., at the sole, to separate the functions of the frame, such as supporting the foot and transmitting forces to and from the foot, from the function of the outer envelope, i.e., protecting against exterior elements.

Figure 5:
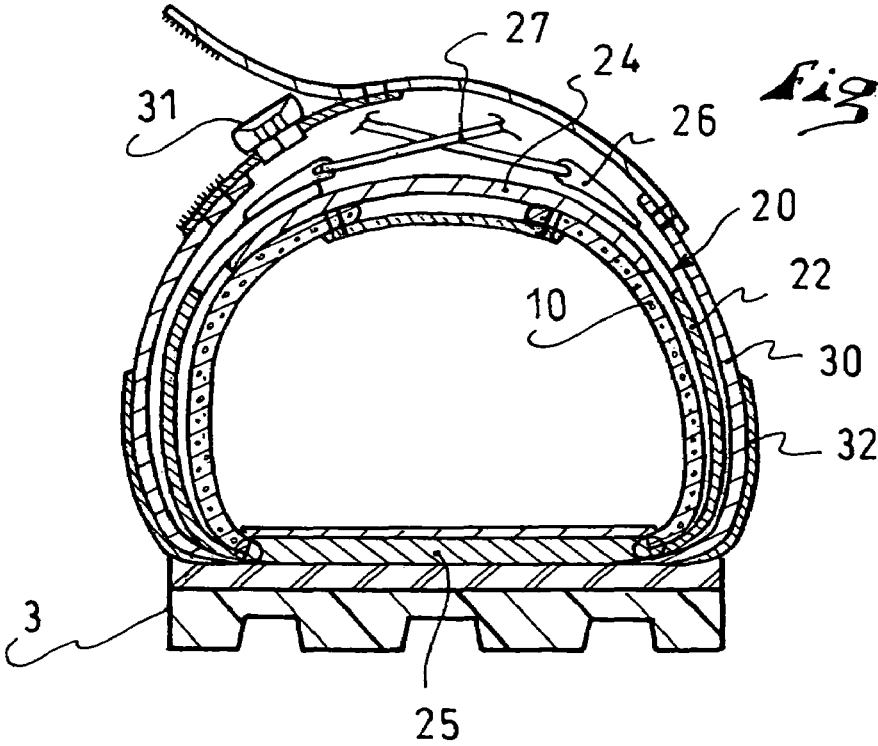
FIG. 5 is a view similar to FIG. 4 according to another embodiment.

In the embodiment shown in FIG. 5, the liner 10 is sewn at the same time as the frame 21, 22, 23, 24 to the sole 25, which is then common to the two layers.

In this case, the liner 10 is not removable. However, the construction of the boot is more compact and lighter, and the foot is closer to the ground since there is no sole thickness.

Figure 6:
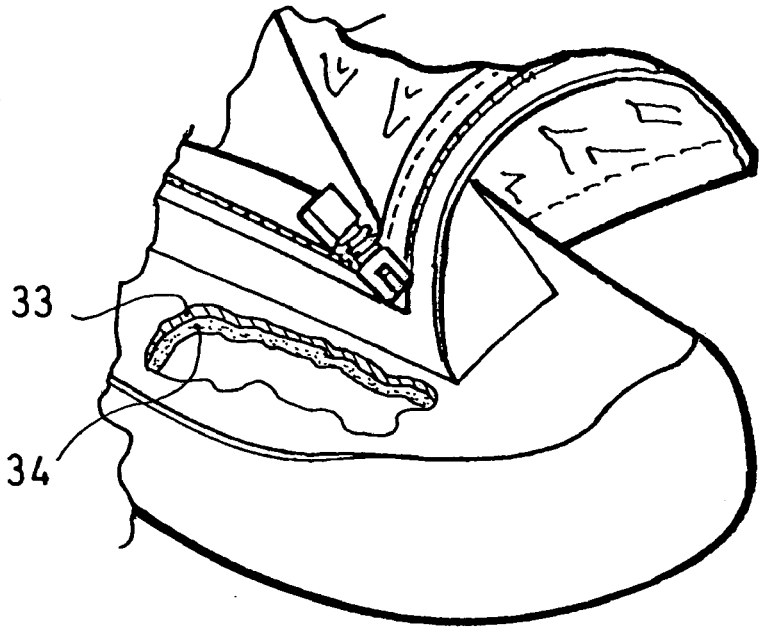
FIG. 6 is a view with a partial cut-away of the outer envelope according to one embodiment.

FIG. 6 shows another embodiment of the outer envelope 30, in which it includes two layers of material 33, 34, respectively, namely a first outer layer 33 made of a material resisting abrasion, such as CORDURA®, and an inner layer 34, made of an insulating foam, such as an EVA foam, in order to increase the thermal-insulation of the boot.

FIGS. 7–10 show various embodiments of the liner 10/frame 20 assembly, in which similar or identical elements are designated by the same reference numerals, increased by 100.

Figure 7:
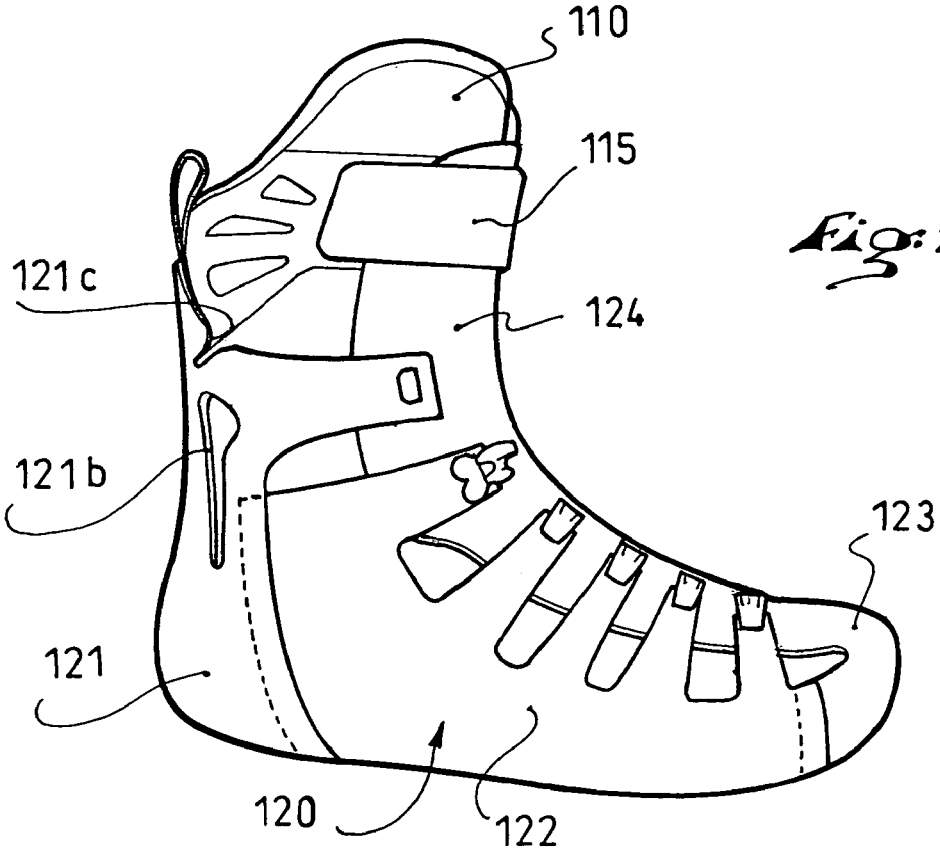
FIG. 7 is a side view of a liner-frame assembly according to a second embodiment.

In the case shown in FIG. 7, the only difference lies in the liner 110 that has, at its upper end, in the area of the tibial base, a strap 115 adapted to cooperate with the top of the tongue 124 in order to provide additional support. Furthermore, the heel stiffener 121 of the frame 120 laterally has two vertical softening slots 121*b*, as well as two cutouts 121*c* adapted in particular for adapting to the dimensions of the calf.

Figure 8:
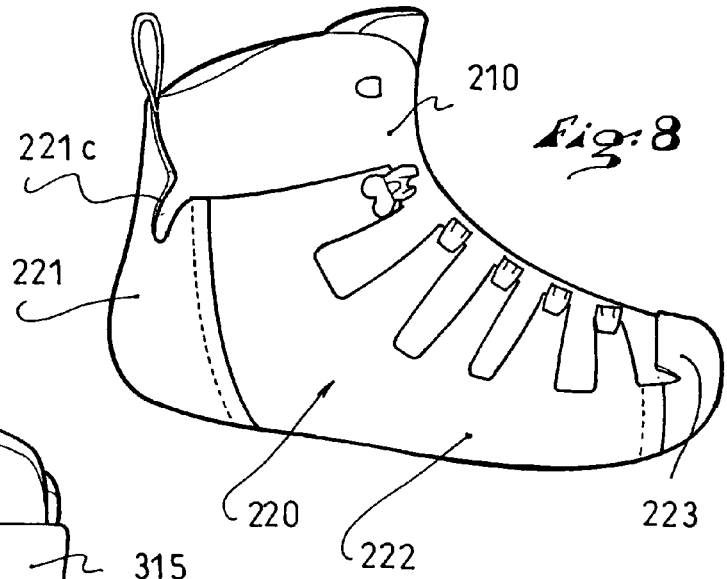
FIGS. 8–10 are views similar to FIG. 7 showing various embodiments of a liner-frame assembly.

In the case of FIG. 8, the boot is of the mid-height type of boot, i.e., it has a semi-high upper, and the heel stiffener 221 is therefore not provided with a high portion or a tightening tab. The flange portion 222 and end piece 223 are furthermore substantially identical, and the liner 210 is also reduced in height. In this embodiment, the frame 220 does not have a tongue. The heel stiffener 221 has two softening cutouts 221*c*.

Figure 9:
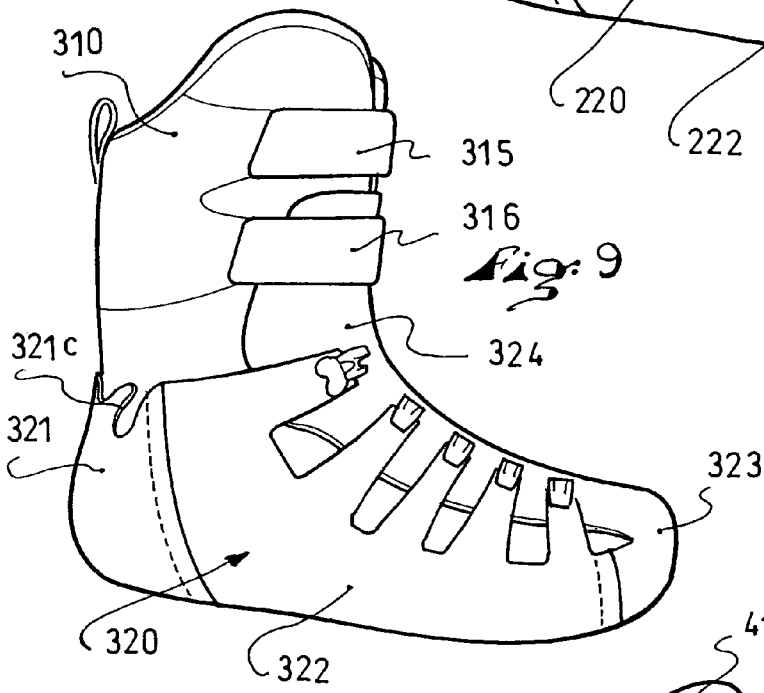

In the case of FIG. 9, the boot has a high liner 310, and is provided at its upper end with two tightening straps 315, 316, respectively; but the frame 320 corresponds to a frame for a low boot, as shown in FIG. 8, but with a tongue 324. In this case, the second tightening strap 316 of the liner cooperates with the upper end of the tongue 324. Here again, the heel stiffener 321 has two softening cutouts 321*c*.

Figure 10:
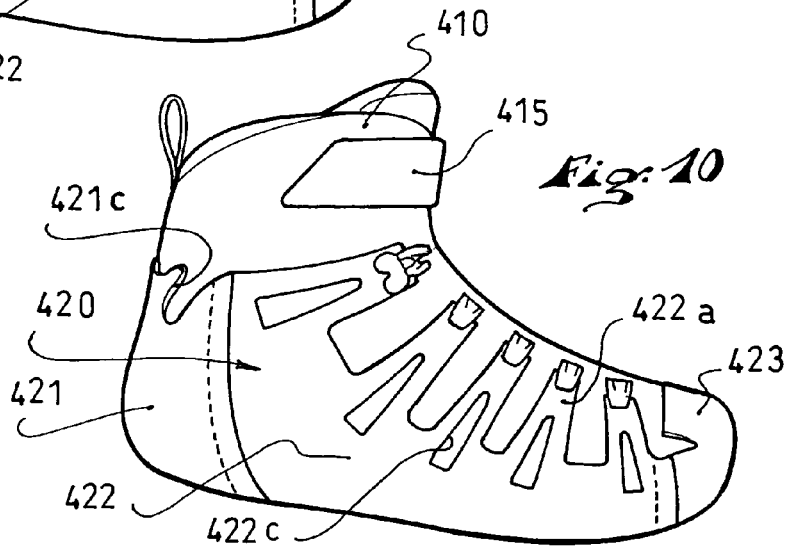

The embodiment of FIG. 10 corresponds substantially to that of FIG. 8, i.e., the boot is of the mid-height type and the heel stiffener 421 is not provided with a high portion, but has two softening cutouts 321*c*, the frame 420 also not having a tongue.

In this embodiment, the wings 422*a* of the tightening flanges 422 are cut out by holes 422*c* for more flexibility.

Furthermore, the liner 410 has a single tightening tab 415.

The present invention is not limited to the particular embodiments described hereinabove by way of non-limiting examples, but encompasses all constructions and equivalents that are within the scope of the following claims.

What is claimed is:

1. An article of footwear comprising:

an outer sole;

an upper extending above the outer sole, the upper comprising, from an inside to an outside of the article of footwear:

a comfort liner;

a frame comprising a substantially inextensible material to provide the functions of supporting a foot of a wearer and transmitting forces to and from the foot of the wearer; and an outer envelope comprising a flexible material to provide the function of protecting against exterior elements;

the frame being separate from the outer envelope above a lowermost connection relative to the outer envelope to separate the functions of the frame from the function of the outer envelope.

2. An article of footwear according to claim 1, wherein:

the frame comprises a heel stiffener, two tightening flanges arranged laterally and medially, respectively, and provided with a tightening mechanism and an end piece.

3. An article of footwear according to claim 2, wherein:

the tightening flanges are made of a material that is more flexible than the heel stiffener and the end piece.

4. An article of footwear according to claim 2, wherein:

the frame comprises several distinct portions assembled together.

5. An article of footwear according to claim 4, wherein:

the zones for assembling the different portions of the frame are compatible with at least two successive boot sizes.

6. An article of footwear according to claim 1, wherein:

the comfort liner is removable.

7. An article of footwear according to claim 1, wherein:

the liner is affixed to the frame.

8. An article of footwear according to claim 1, wherein:

the outer envelope is made of an abrasion-resistant material.

9. An article of footwear according to claim 1, wherein:

the outer envelope is lined internally with an insulating material.

10. An article of footwear according to claim 2, wherein:

said end piece is a toe end piece.

11. An article of footwear according to claim 1, further comprising:

a tightening mechanism for tightening the frame on the foot of the wearer; and a closure movable between open and closed positions to open the outer envelope, facilitating entry and exit of the foot of the wearer from the article of footwear, and to close the article of footwear with the foot of the wearer within the article of footwear.

12. An article of footwear according to claim 11, wherein:

said tightening mechanism for the frame comprises a lace and a plurality of keepers, said lace being guided by said plurality of keepers within a lacing zone; and said closure of for said outer envelope is a slide fastener.

13. An article of footwear according to claim 1, wherein:

the frame is connected relative to a lowermost extent of the envelope by means of both the frame and the lowermost extent of the envelope being affixed to the outer sole.

14. An article of footwear according to claim 1, wherein:

the frame comprises a sole;

the frame is connected relative to a lowermost extent of the envelope by means of both the sole of the frame and the lowermost extent of the envelope being affixed to the outer sole.

15. An article of footwear according to claim 1, wherein:

the substantially inextensible material of the frame comprises a molded plastic.

16. An article of footwear according to claim 1, further comprising:

a closure movable between open and closed positions to open the outer envelope, facilitating entry and exit of the foot of the wearer from the article of footwear, and to close the article of footwear with the foot of the wearer within the article of footwear;

the outer envelope comprising a material sufficiently flexible to enable the outer envelope to be folded down to expose upper extents of the frame and the liner in the open position of the closure.

17. An article of footwear according to claim 1, wherein:

said outer envelope is a gaiter.

18. An article of footwear according to claim 1, wherein:

said frame comprises a plurality of molded plastic parts assembled together; and said outer envelope comprises an abrasion-resistant textile material.

19. An article of footwear according to claim 1, wherein:

said frame comprises:

a sole;

a heel stiffener extending upwardly of the sole and rearward of the foot of the wearer;

a toe piece extending upwardly of the sole and forward of the foot of the wearer.

20. An article of footwear according to claim 19, wherein:

said frame further comprises a tongue extending rearward from said toe piece above the foot of the wearer.

21. An article of footwear according to claim 1 wherein:

the frame for supporting the foot and for transmitting forces is made of an inextensible plastic material.

22. An article of footwear comprising:

an outer sole;

an upper extending above the outer sole, the upper comprising, from an inside to an outside of the article of footwear:

a comfort liner;

a frame for holding a foot of a wearer and for transmitting forces, the frame comprising a substantially inextensible material for transmitting said forces, tightening the foot, and supporting the foot; and an outer envelope for protecting against exterior elements;

the frame comprising a heel stiffener, two tightening flanges arranged laterally and medially, respectively, and being provided with a tightening mechanism and an end piece;

the frame comprising a tongue extending under a tightening zone.

23. An article of footwear according to claim 22, wherein:

the tongue is affixed to the end piece.

24. An article of footwear according to claim 23, wherein:

said end piece is a toe end piece.

25. An article of footwear comprising:

an outer sole;

an upper extending above the outer sole, the upper comprising, from an inside to an outside of the article of footwear:

a comfort liner;

a frame for holding a foot of a wearer and for transmitting forces, the frame comprising a substantially inextensible material for transmitting said forces, for tightening the foot, and for supporting the foot; and an outer envelope for protecting against exterior elements;

the frame comprising a heel stiffener, two tightening flanges arranged laterally and medially, respectively, and being provided with a tightening mechanism and an end piece;

the frame comprising several distinct portions assembled together by stitching.

* * * * *